US007043802B2

(12) United States Patent
Moeller et al.

(10) Patent No.: US 7,043,802 B2
(45) Date of Patent: May 16, 2006

(54) ZIPPER PULL WITH WHISTLE

(75) Inventors: Thomas A. Moeller, Stateline, NV (US); John S. Pontaoe, Chicago, IL (US)

(73) Assignee: Illinois Tool Works Inc, Glenview, IL (US)

( * ) Notice: Subject to any disclaimer, the term of this patent is extended or adjusted under 35 U.S.C. 154(b) by 0 days.

(21) Appl. No.: 10/721,937

(22) Filed: Nov. 25, 2003

(65) Prior Publication Data

US 2004/0148745 A1 Aug. 5, 2004

Related U.S. Application Data

(60) Provisional application No. 60/443,761, filed on Jan. 30, 2003.

(51) Int. Cl.
*A44B 19/26* (2006.01)

(52) U.S. Cl. ..... 24/429

(58) Field of Classification Search ..... 446/204, 446/404; 116/137 R, 24; 24/429, 431; D10/119
See application file for complete search history.

(56) References Cited

U.S. PATENT DOCUMENTS

| | | | | |
|---|---|---|---|---|
| 587,795 | A * | 8/1897 | Crosby et al. | 472/52 |
| 1,748,460 | A * | 2/1930 | Petrie | 446/205 |
| 2,666,408 | A * | 1/1954 | Riviere | 116/67 R |
| 2,877,598 | A * | 3/1959 | Seron | 446/204 |
| 3,085,150 | A * | 4/1963 | Bautsch | 362/200 |
| 4,194,714 | A * | 3/1980 | Schultz | 248/308 |
| 4,779,568 | A * | 10/1988 | Finger, Jr. | 116/137 R |
| 5,826,534 | A * | 10/1998 | Huang | 116/137 R |
| 6,026,546 | A * | 2/2000 | Lund et al. | 24/431 |
| 6,058,578 | A * | 5/2000 | Lan | 24/429 |
| 2003/0142506 | A1 * | 7/2003 | Deutsch | 362/500 |

FOREIGN PATENT DOCUMENTS

JP 2002017411 A * 1/2002

OTHER PUBLICATIONS

Braving the Great Outdoors; USA Today (magazine), Jan. 1996; v124, n2608, p. 94.*

* cited by examiner

*Primary Examiner*—James R. Brittain
(74) *Attorney, Agent, or Firm*—Paul F. Donovan; Mark W. Croll

(57) ABSTRACT

A zipper pull mechanism attaches two free ends of a zipper cord together, after the free ends are looped through an eyelet in the zipper slider. The zipper pull mechanism will assist the user in operating the zipper. The zipper pull mechanism includes two components that snap fit easily together and onto the free ends of the zipper cord, thereby securing the zipper cord to the zipper slider. The zipper pull mechanism also includes a whistle integrated into the shape of the mechanism to be used to create a loud piercing noise so as to attract attention to the user. The zipper pull mechanism is easy to grip even by users wearing gloves.

17 Claims, 10 Drawing Sheets

ZIPPER PULL WITH WHISTLE

CROSS REFERENCE TO RELATED APPLICATION

This Non-Provisional Application claims benefit to U.S. Provisional Application Ser. No. 60/443,761 filed Jan. 30, 2003.

FIELD OF THE INVENTION

The present invention relates generally to zipper pulls and more particularly to zipper pull mechanisms that secure zipper cords to zipper sliders. The present invention is also directed to incorporating a whistle into the zipper pull mechanism that may be used to create a loud piercing sound that can attract attention to the user.

BACKGROUND OF THE INVENTION

It is known to use zipper pulls to assist the user in operating a zipper from a closed position to an open position and vice versa. Known zipper pulls use cords or other attachments that are looped or connected to the eyelet of the zipper slider to give the user additional gripping means to pull and slide the zipper. For example, U.S. Pat. No. 6,415,482, issued to Pontaoe, assigned to Illinois Tool Works Inc., and incorporated herein by reference, discloses a known zipper pull device that includes components that are used to secure a zipper cord onto an eyelet of a zipper slider. As shown in that patent, a female portion includes a hollow frame into which is inserted a male element. The male portion includes slots and barbs into which is inserted the free ends of the zipper cord, after the zipper cord is looped through the eyelet of the zipper slider. Upon assembly of the male and female components, the zipper cord will be secured to the zipper pull device and also the zipper slider.

It is further known that whistles may be used in situations where it is desirous to generate a loud piercing sound to attract attention to the user. Unfortunately, it is not uncommon for one to forget he/she may have access to such whistles, or to lose or misplace such whistles, therefore rendering such whistles useless.

The present invention is directed at improving upon existing zipper pull mechanisms while at the same time providing a zipper pull mechanism that also serves as a whistle.

SUMMARY OF THE INVENTION

The present invention is directed to an improved zipper pull mechanism that joins the free ends of a zipper cord, after the zipper cord is looped through an eyelet or aperture in the zipper slider. The zipper pull mechanism of the invention includes a plurality of components that easily snap fit together and onto the free ends of the zipper cord, thereby securing the zipper cord to the zipper slider. The present invention is easier to grip than known zipper pull mechanisms, especially by users wearing gloves, greatly enhancing the user's operation of the zipper. The present invention is also directed to a zipper pull mechanism that includes a whistle integrated into the shape of the zipper pull mechanism to be used when the used desires to generate a loud piercing noise to attract attention.

Other features and advantages of the invention will become apparent to those skilled in the art upon review of the following detailed description, claims and drawings in which like numerals are used to designate like features.

Figure 1:
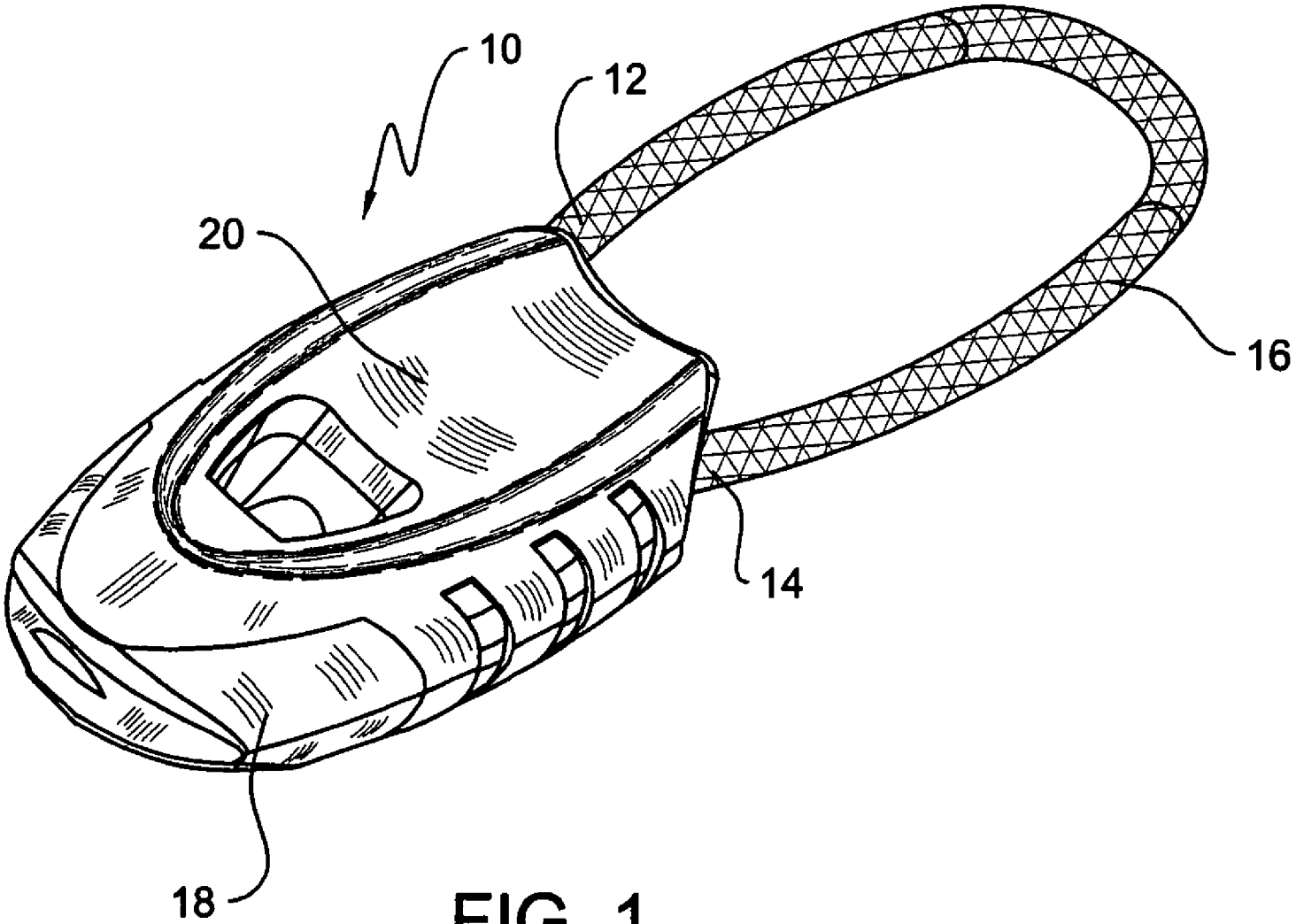
FIG. 1 is an isometric view of an exemplary zipper pull mechanism of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE EMBODIMENTS

Referring to FIG. 1, an exemplary embodiment of the invention is depicted as a zipper pull mechanism 10. The zipper pull mechanism 10 attaches to a zipper ending, such as two free ends 12, 14 of a piece of zipper cord 16 that may be looped through an eyelet in a zipper slider, not shown. It is contemplated, however, that the zipper pull mechanism 10 may attach directly to the zipper slider. With the present invention, a user easily grips the zipper pull mechanism 10, thereby enhancing the user's operation of the zipper. In addition, the present invention integrates a whistle into the shape of the zipper pull mechanism 10, as discussed below. As exemplified by FIG. 1, the zipper pull mechanism 10 includes two primary components—a whistle body 18 and an outer frame 20 that snap fits onto the whistle body 18. In use, and as depicted in FIGS. 1 and 2, the whistle body 18 and outer frame 20 trap the ends 12, 14 of the cord 16 within the zipper pull mechanism 10 creating a closed loop zipper pull device.

Figure 2:
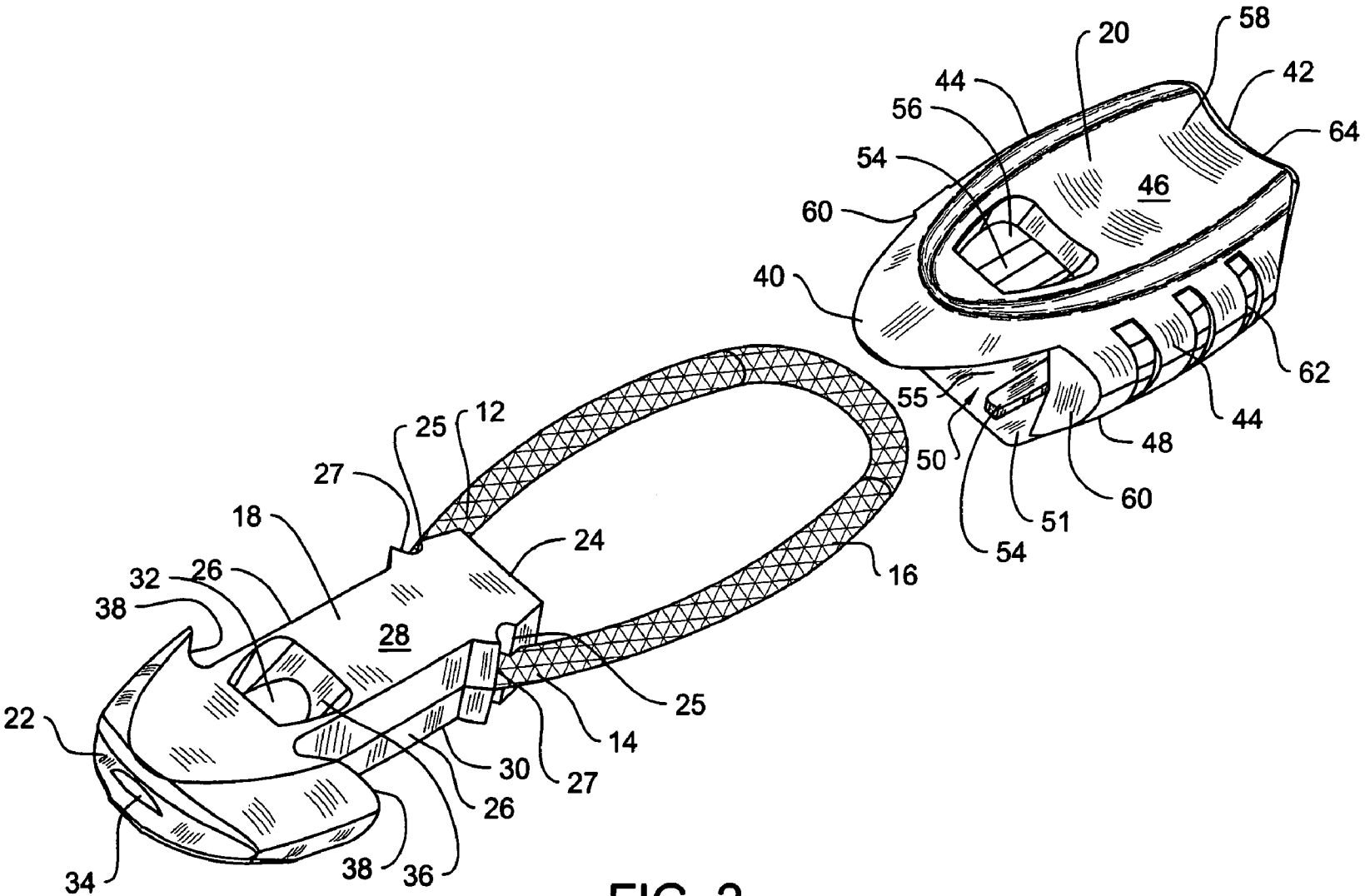
FIG. 2 is an exploded isometric view of the invention of FIG. 1.

Referring to FIG. 2, the whistle body 18, and accompanying zipper cord 16, is shown separated from the outer frame 20. In an exemplary embodiment, the whistle body 18 is molded from plastic, rubber, or a similar suitable material, and defines a front end 22, a back end 24, opposing side walls 26, a top surface wall 28 and a bottom surface wall 30. The whistle body 18 includes a hollow whistle cavity 32 defined by an inlet hole 34 in the front end 22 and an exhaust hole 36 formed on the top surface 28. In use, a user, by blowing sharply into the inlet hole 34 and out of the exhaust hole 36 will create a loud piercing sound that will attract attention to the user. The front end 22 of the whistle body 18 defines a contoured body that terminates at front-end walls 38. The front-end walls 38 define an engagement surface for the outer frame 20 after the outer frame 20 is mounted onto the whistle body 18.

Located near the back end 24 of the whistle body 18 are gripping elements or barbs 25 positioned along the side walls 26 of the whistle body 18. The gripping elements or barbs 25 may take on various shapes including the depicted jagged elements. The gripping elements 25 serve as a gripping surface and interference point to secure the free ends 12, 14 of the cord 16 between the whistle body 18 and the outer frame 20 of the zipper pull mechanism 10. Also located near the back end 24 are a pair of opposing securement or gripping tabs 27 extending outwardly from the side walls 26. Tabs or barbs 27 can be used to further secure the free ends 12, 14 of the cord 16 between the whistle body 18 and the outer frame 20. Alternatively, according to one aspect of the invention, the tabs 27 can be caused to engage slots 62 in the outer frame 20 to facilitate snap-fitting the outer frame 20 onto the whistle body 18, as discussed below. According to another aspect of the invention, although not shown, surface 28 and/or surface 30 of whistle body 18 can include a tab or barb that is configured and adapted to cooperate with a recess or opening provided on the inside of the outer frame 20 to allow for the snap-fitting of the outer frame 20 onto the whistle body 18. Naturally, the outer frame 20 could include a tab or barb and the whistle body 18 could have an associated recess or opening.

Figure 3:
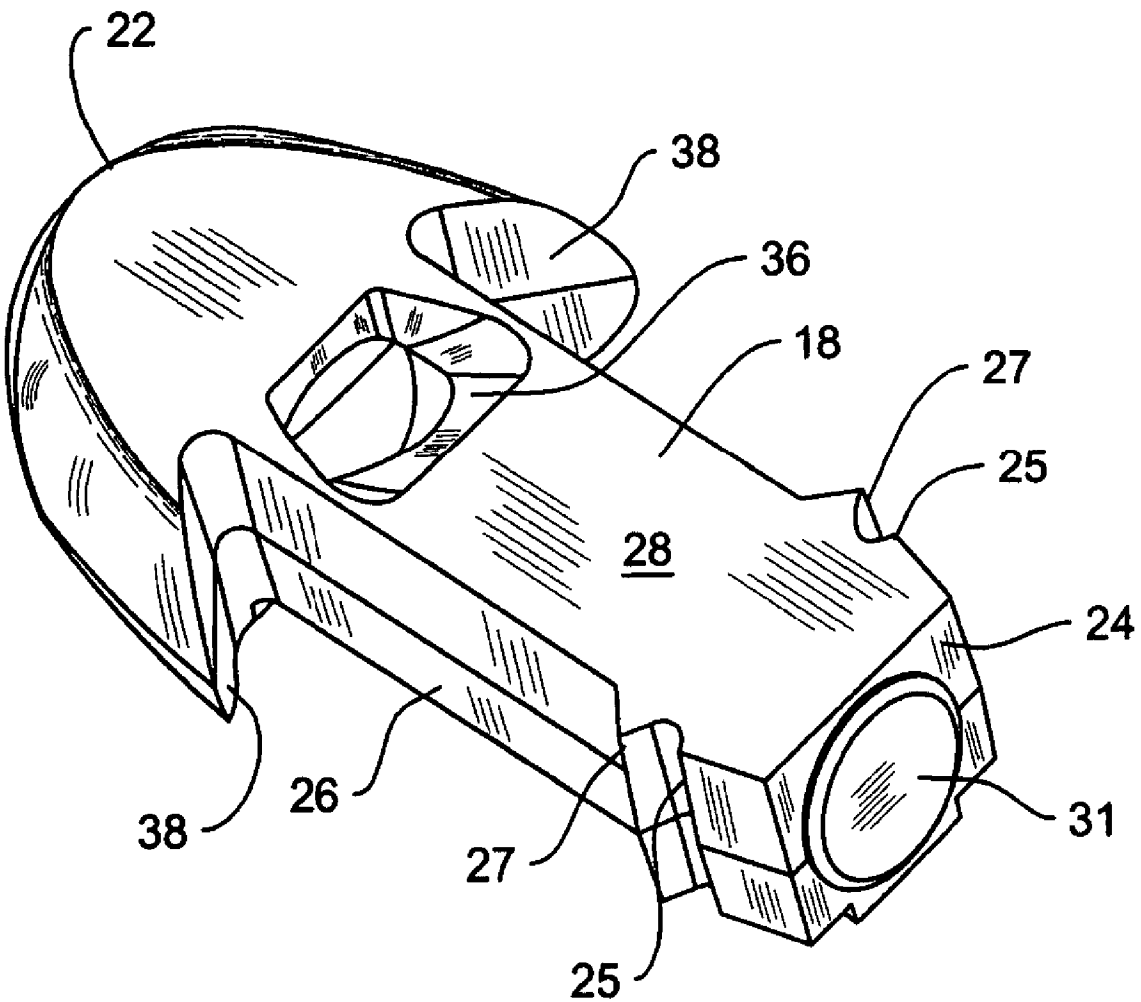
FIG. 3 is an isometric view of the whistle body of the invention of FIG. 1 with the whistle cap installed.
Figure 4:
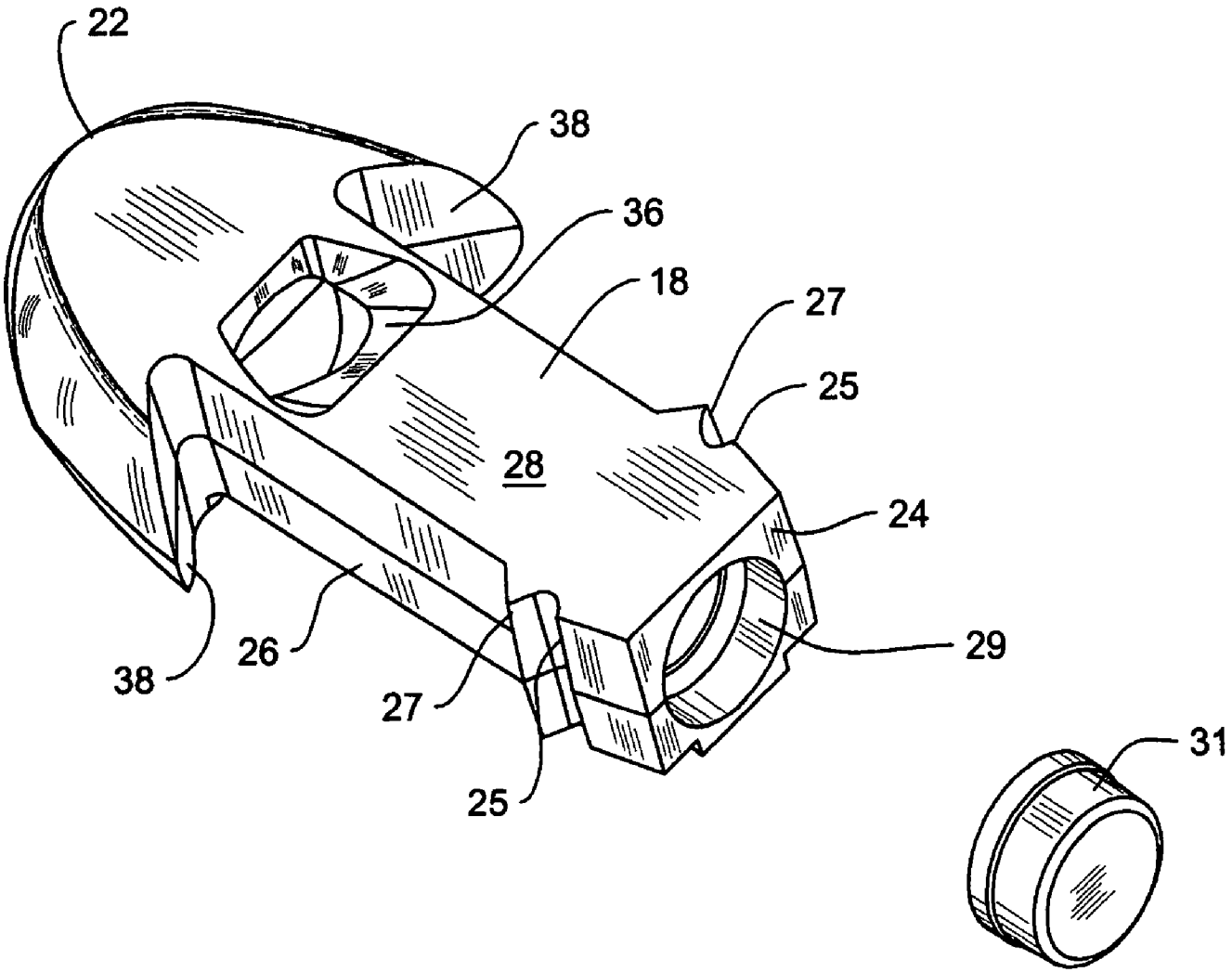
FIG. 4 is an isometric view of the whistle body of the invention of FIG. 1 with the whistle cap removed.

Referring to FIGS. 3 and 4, located on the back end 24 is an opening 29 that receives a removable whistle cap 31. The whistle cap 31 permits the user to select whether the invention will function as a whistle. That is, if the user desires the invention to function as a whistle, the whistle cap 31 must be placed into the opening 29 to close the opening 29, thereby forcing blown air through the exhaust hole 36. If the user desires the invention to not function as a whistle, the cap 31 may be removed from the opening 29, thereby permitting the blown air to escape through the opening 29 and out of the whistle body 18 without creating a loud piercing sound. It should be understood that other types or forms or whistle caps may be used with the present invention to permit the selective use of the invention as a whistle.

Referring back to FIG. 2, the outer frame 20 is also molded from plastic, rubber, or a similar suitable material and defines a front end 40, a back end 42, opposing side walls 44, a top surface wall 46 and a bottom surface wall 48. The front end 40 defines a body substantially matching the shape of the contoured front end 22 of the whistle body 18. The front end 40 includes an opening 50 bounded by the opposing side walls 44 and the top and bottom surface walls 46, 48 that serves as a passageway to receive the whistle body 18. Located near the front end 40 on the inside surface 51 of the bottom surface wall 48 are a pair of guidance lugs 54 that define a guide channel 55 for aligning the whistle body 18 within the outer frame 20. In other words, as the whistle body 18 is inserted into the outer frame 20 to form the zipper pull mechanism 10, the side walls 26 of the whistle body 18 will pass between the guidance lugs 54 in the guide channel 55 in the outer frame 20 to align the whistle body 18 relative to the outer frame 20. The outer frame 20 further includes an exhaust hole 56 located on the top surface wall 46. As assembled, the exhaust hole 56 aligns with the exhaust hole 36 of the whistle body 18 to permit the air blown through the whistle body 18 to escape out of the zipper pull mechanism 10. The top surface wall 46 defines a concave, recessed surface 58 that assists the user in gripping the zipper pull mechanism 10 and also in snap-fitting the outer frame 20 onto the whistle body 18. In an exemplary embodiment, the exhaust hole 56 is positioned within the recessed surface 58.

Each of the opposing side walls 44 define a contoured outer surface and include end walls 60 that, as assembled, will contact and engage with the front end walls 38 of the whistle body 18. The side walls 44 also include slots 62 that serve as exterior gripping surfaces for the user and can be considered as aesthetic windows to permit the user to view the inserted whistle body 18. As previously noted, in one embodiment, the slots 62 can also permit the securement tabs 27 to engage the outer frame 20, thereby snap-fitting the frame 20 onto the whistle body 18. Because the outer frame 20 is hollow, the back end 42 of the outer frame 20 defines an opening 64 for receiving the back end 24 of the whistle body 18 and for receiving the free ends 12, 14 of the cord 16. The opening 64 is sized and shaped to permit the free ends 12, 14 to pass between the inside surface of the side walls 44 and the gripping elements 25 positioned on the side walls 26 of the whistle body 18. As assembled, the gripping elements 25 serve as interference points to trap the free ends 12, 14 of the cord 16 between the whistle body 18 and the outer frame 20 and within the zipper pull mechanism 10.

According to one aspect of the invention, to assemble the exemplary zipper pull mechanism 10 onto a zipper, a user loops the cord 16 through an eyelet in the zipper slide and feeds the free ends 12, 14 through the hollow outer frame 20 and out the opening 50 in the front end 40 of the frame 20. Next, the user positions the free ends 12, 14 across the gripping elements 25 on the whistle body 18. The user then slides the outer frame 20 over the whistle body 18 until the outer frame 20 snap fits onto the whistle body 18, thereby securing the free ends 12, 14 of the cord 16 between the outer frame 20 and the whistle body 18. It should be appreciated that to assemble the zipper pull mechanism 10 no special tools are required and the assembly can be accomplished easily by hand.

Figure 6:
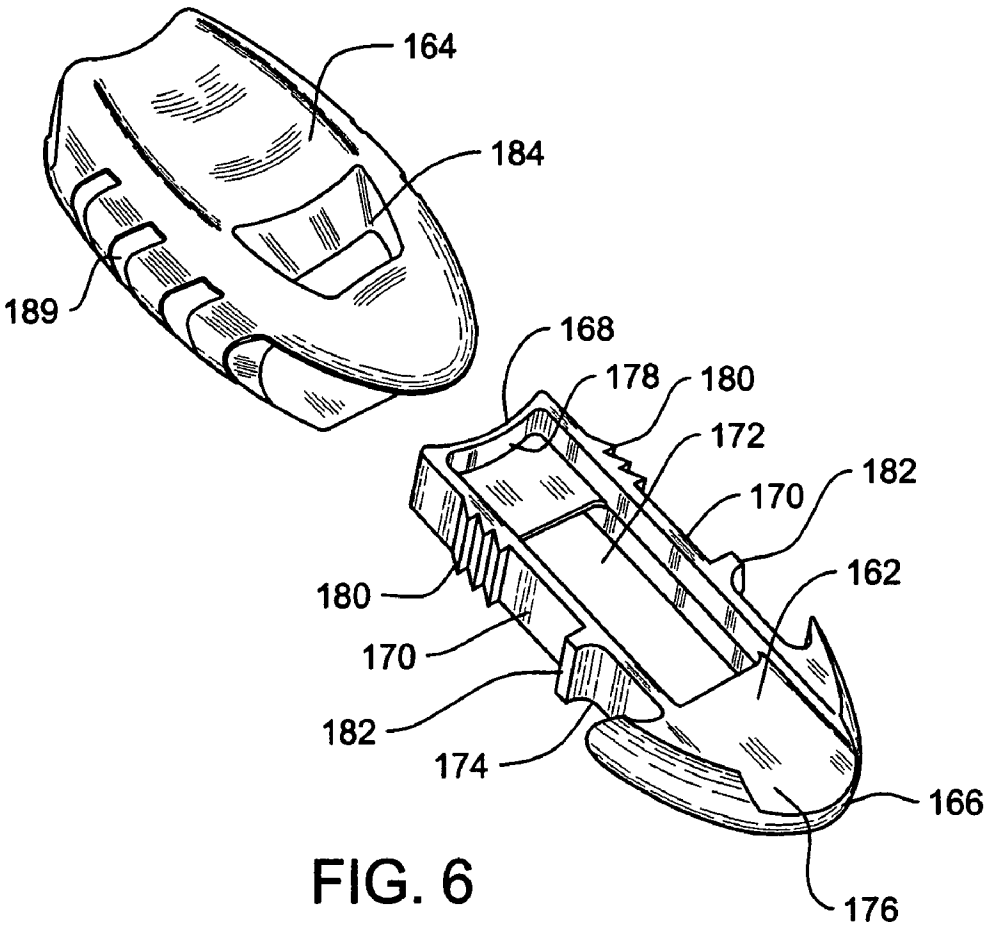
FIG. 6 is an exploded isometric view of the invention of FIG. 5.
Figure 5:
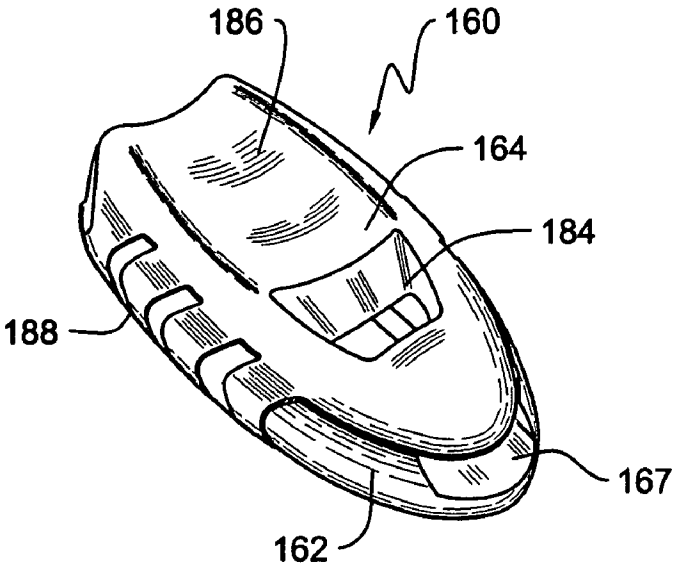
FIG. 5 is an isometric view of another exemplary zipper pull mechanism of the present invention.
Figure 7:
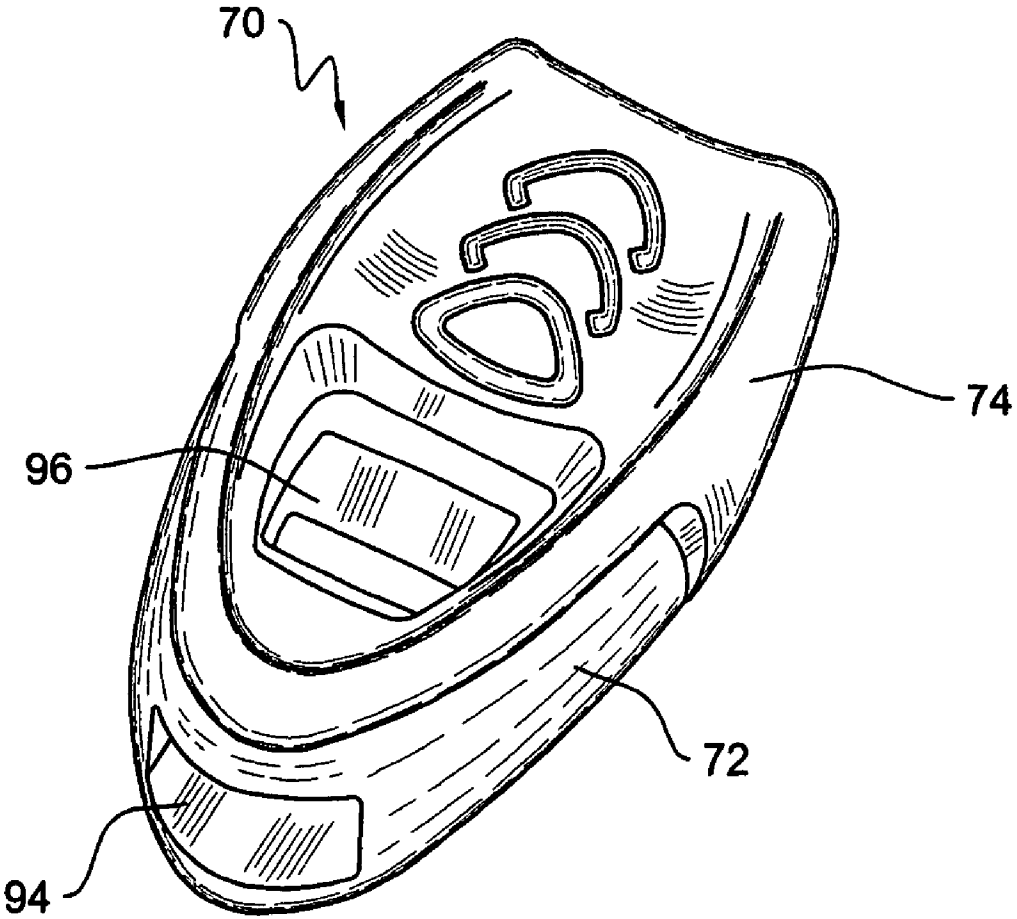
FIG. 7 is an isometric view of yet another exemplary zipper pull mechanism of the present invention.

Another exemplary embodiment of a zipper pull mechanism is depicted in FIGS. 5 and 6. Many of the details of this embodiment are common with the above embodiment and therefore will not be repeated. The zipper pull mechanism 160 includes a whistle body 162 and an outer frame 164. With this embodiment, a whistle cap is not required. The whistle body 162 includes a front end 166, a back end 168, opposing side walls 170, an open top surface wall 172, and an open bottom surface wall 174. The front end 166 defines a contoured shape and a channel 176 that, when the whistle body 162 is assembled to the outer frame 164, serves as an inlet hole 167 for the user to blow into and operate the whistle feature. The back end 168 includes a solid wall 178 that, as assembled, will direct the blown air up through the exhaust hole 184 in the outer frame 164. The opposing side walls 170 include a plurality of gripping elements or barbs 180 that will serve as interference points to secure the loose ends of the zipper cord, not shown but described above, within the zipper pull mechanism 160. The opposing side walls 170 also include a pair of outwardly extending securement tabs 182 that will seat within mating detents formed in the inner wall of the outer frame 164. The seating of the securement tabs 182 within the detents permits the outer frame 164 to snap-fit onto the whistle body 162. Alternatively, other snap fit arrangements, such as those described above, could be utilized in accordance with the principles of the present invention.

The outer frame 164 is similar to the outer frame 20, described above, and includes an exhaust hole 184 to permit the escape of air blown into the zipper pull mechanism 160 via the inlet hole 167 and across the channel 176, thereby creating a loud piercing sound that will attract attention to the user. The outer frame 164 also includes a concave, recessed top and bottom surface walls 186, 188 to enhance the users grip onto the outer frame 164 of the zipper pull mechanism 160. Gripping elements 189 are also located on the side walls of the outer frame 164. With this embodiment, there is no separate whistle cap to permit the user to selectively choose whether the zipper pull mechanism will function as a whistle. In other words, with this embodiment, the zipper pull mechanism 160 is configured to function as whistle.

Figure 9:
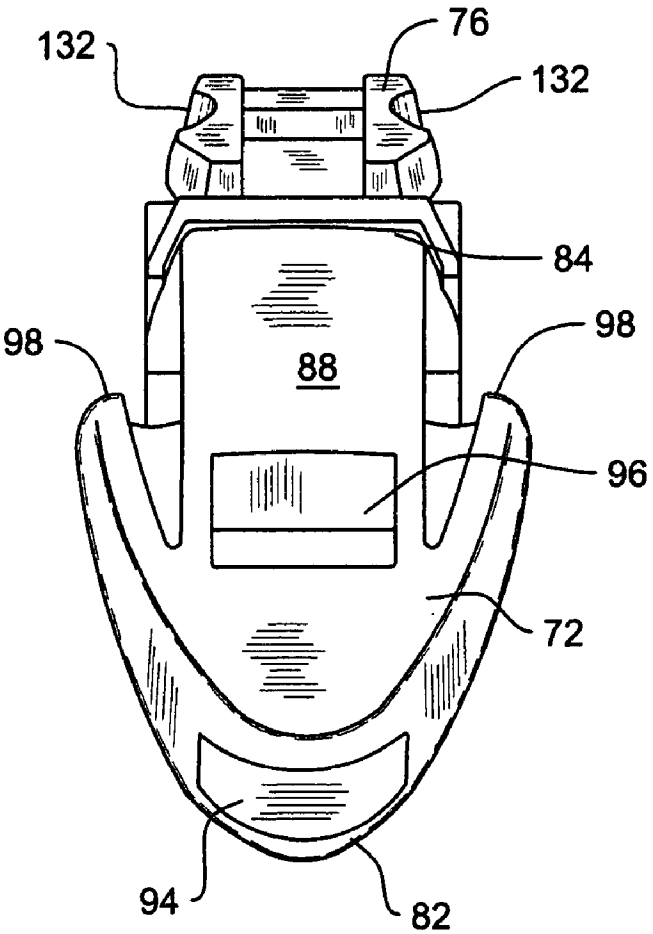
FIG. 9 is an isometric view of the whistle body of the invention of FIG. 7.
Figure 10:
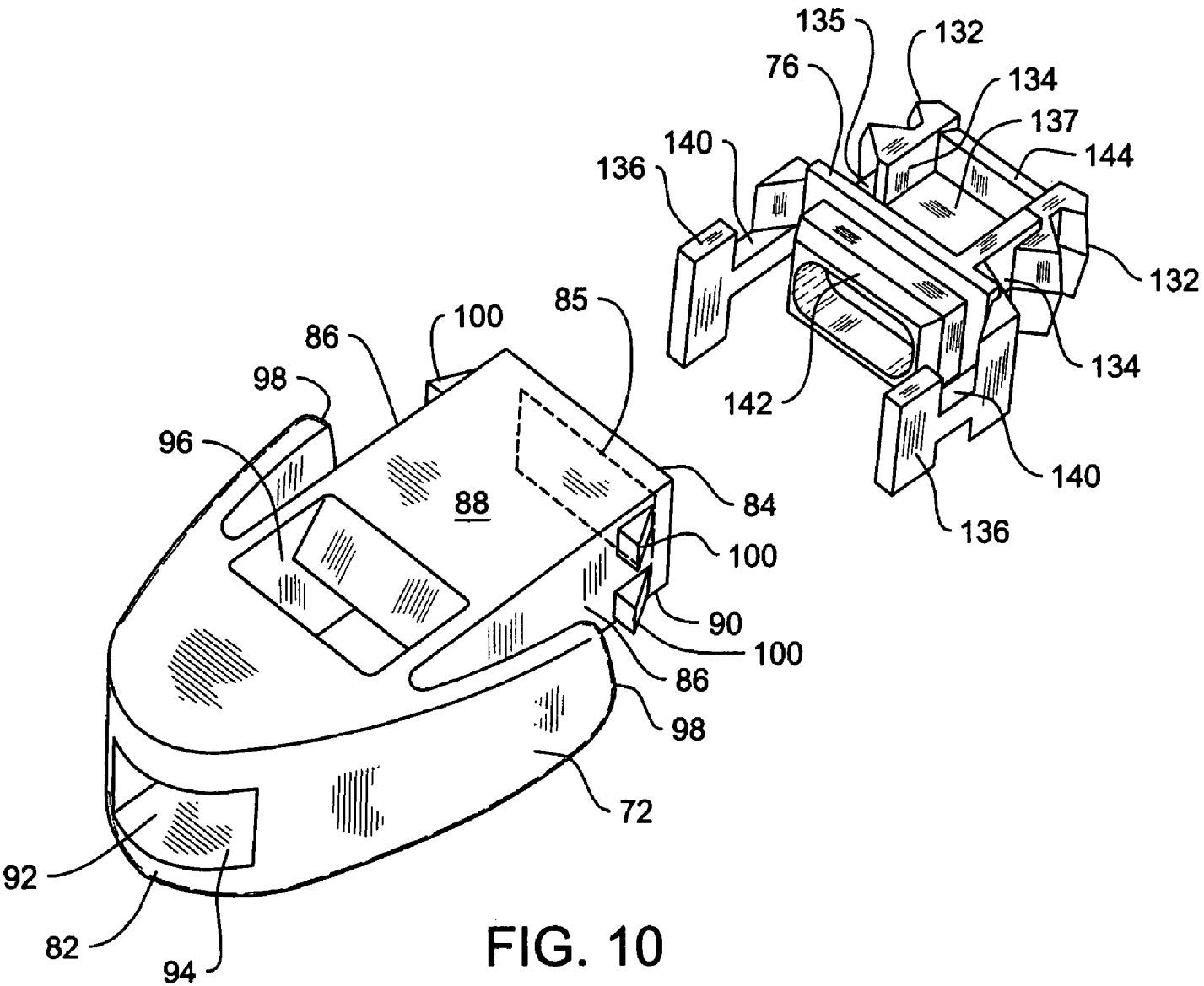
FIG. 10 is an isometric view of the whistle body and whistle cap of the invention of FIG. 7.
Figure 11:
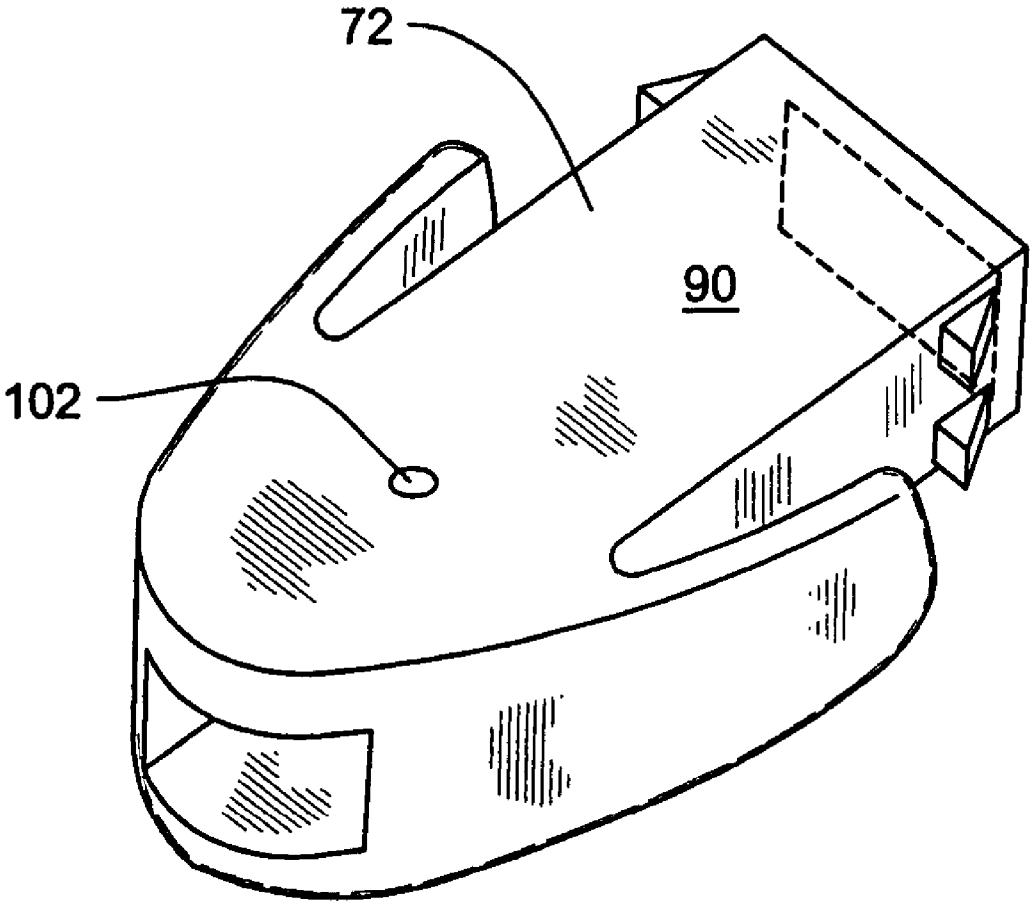
FIG. 11 is an isometric bottom view of the whistle body of the invention of FIG. 7.

Yet another exemplary embodiment of a zipper pull mechanism 70 of the invention is depicted in FIGS. 7–12. The exemplary zipper pull mechanism 70 is similar to the above embodiments in many respects and includes a whistle body 72, an outer frame 74 and a whistle cap 76. Although, cap 76 can be designed for all practical purposes to not be a removable cap, thereby ensuring that the zipper pull mechanism will function as a whistle. Referring to FIGS. 9 and 10, the whistle body 72 defines a front end 82, a back end 84, opposing side walls 86, a top surface wall 88 and a bottom surface wall 90. As depicted in FIG. 10, the whistle body 72 includes a whistle cavity 92. The whistle cavity 92 is defined by an inlet hole 94 in the front end 82 and an exhaust hole 96 extending through the top surface wall 88. The front end 82 of the whistle body is contoured and terminates at front end walls 98. Located near the back end 84 of the whistle body 72 and positioned on both side walls 86 are securement tabs 100 for securing the whistle cap 76 to the whistle body 72. The tabs 100 permit the whistle cap 76 to snap fit onto the whistle body 72. The back end 84 further defines an opening 85 that is sized and shaped to receive the whistle cap 76. As illustrated in FIG. 11, located on the bottom surface wall 90 is an aperture 102 that extends through the surface wall 90 and serves as a passage to permit water, saliva or other fluid to escape out of the interior of the whistle body 72. Referring to FIGS. 9 and 10, connected to the back end 84 of the whistle body 72 is the whistle cap 76.

Figure 8:
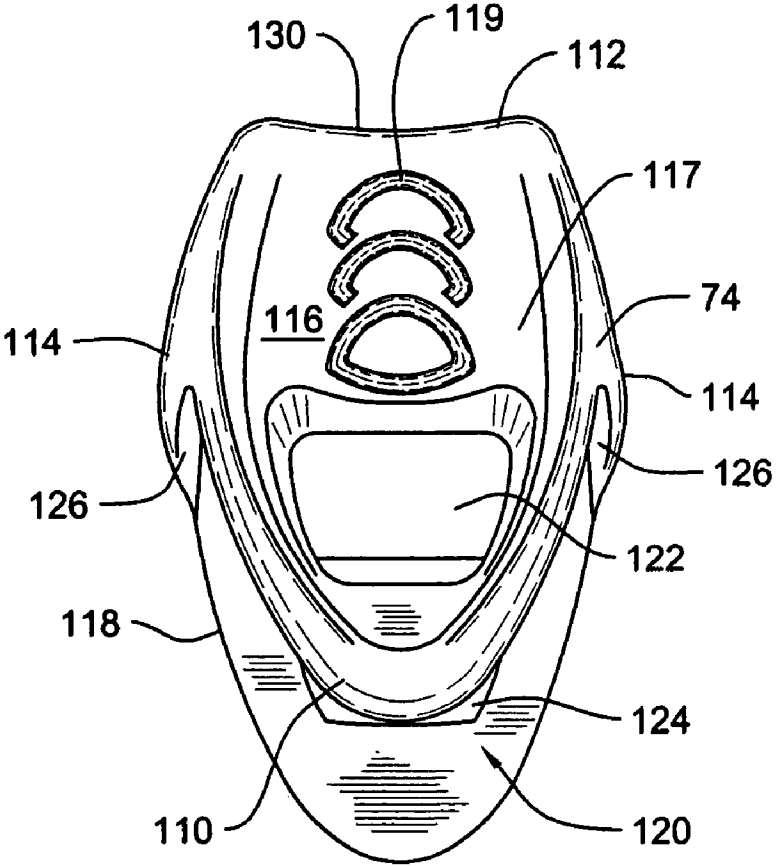
FIG. 8 is an isometric view of the frame of the invention of FIG. 7.

Referring to FIG. 8, the outer frame 74 defines a front end 110, a back end 112, opposing side walls 114, a top surface wall 116 and a bottom surface wall 118. The front end 110 defines a body that is sized and shaped to substantially match the shape of the contoured front end 82 of the whistle body 72. The front end 110 includes an opening 120 that is sized and shaped to receive the whistle body 72 and the whistle cap 76. Located near the front end 110 through the top surface wall 116 is an exhaust hole 122 that, when assembled, aligns with the exhaust hole 96 and permits the escape of air blown through the inlet hole 94. The top surface wall 116 defines a recess 117 and a plurality of gripping elements 119 formed thereon to assist the user in gripping the zipper pull mechanism 70. In an exemplary embodiment, the exhaust hole 122 is positioned within the recessed surface 117. Also located near the front end 110 and extending through the bottom surface wall 118 is an opening 124 that aligns with the aperture 102. The opening 124 permits the escape of water, saliva or other fluid from the aperture 102 in the whistle body 72 out of the zipper pull mechanism 70. In one embodiment, surface 116 and surface 118 can include an opening 124, thereby allowing whistle body 72 to be assembled to frame 74 in either orientation.

As depicted in FIG. 8, the opposing side walls 114 are contoured to match the contour of the whistle body 72 and include end walls 126 that, as assembled, will contact and engage with the front end walls 98 of the whistle body 72. Because the outer frame 74 is hollow, the back end 112 of the outer frame 74 defines an opening 130 for receiving the whistle cap 76 and for receiving the free ends of the cord. The opening 130 is sized and shaped to permit the free ends of the cords to pass between the inside surface of the side walls 114 and the gripping elements 132 positioned on the side walls 134 of the whistle cap 76, as discussed below.

Referring to FIG. 10, in an exemplary embodiment, the whistle cap 76 defines a pair of outwardly extending fingers 136 that snap fit onto the securement tabs 100 of the whistle body 72. Specifically, each of the fingers 136 define opposing grooves 140 formed on the fingers 136 that are sized and shaped to engage and snap-fit onto the securement tabs 100. The whistle cap 76 further defines an inner end 142 and an outer end 144. The inner end 142 is sized and shaped to mate with the opening 85 of the whistle body 72 and to seal the opening 85, thereby permitting the whistle body 72 to function as a whistle. Near the outer end 144 are the gripping elements 132 positioned on the side walls 134 of the whistle cap 76. A channel 135 is located on one of the side walls 134 to define an opening for one of the cord ends to pass through and into a chamber 137, as discussed below. The other end of the cord passes through a similar channel (not shown) and into a similar chamber (not shown) on the other side of the cap 76.

Figure 12:
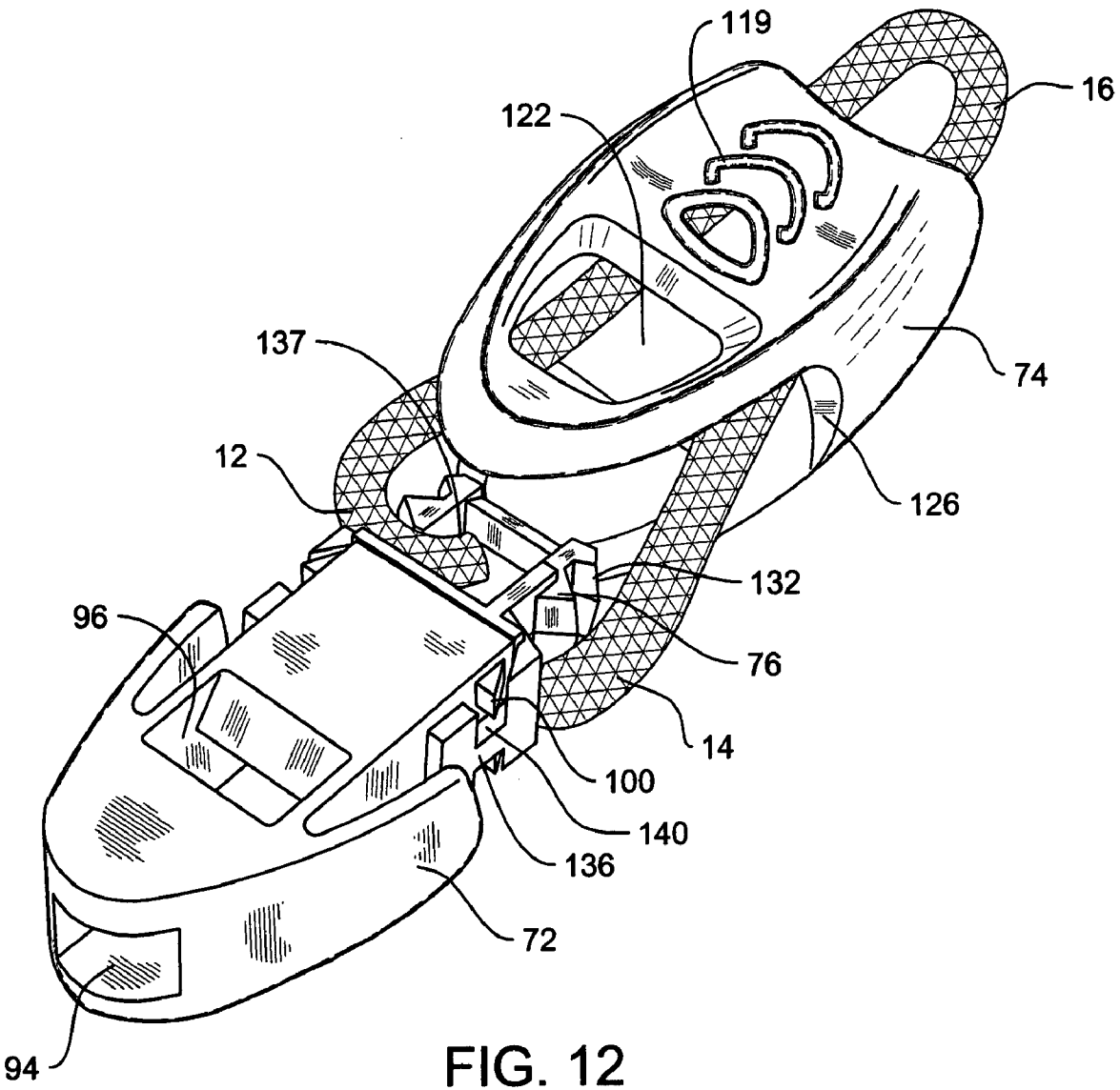
FIG. 12 is an isometric view of an exemplary assembly of a whistle cord onto the invention of FIG. 7.

Similar to the above embodiments, and as depicted in FIG. 12, to assemble the exemplary zipper pull mechanism 70 onto a zipper, a user loops the cord 16 through an eyelet in the zipper slider, not shown, and feeds the free ends 12, 14 of the cord 16 through the hollow outer frame 74 and out the opening 120 in the front end 110 of the outer frame 74. The user then positions free end 12 through the channel 135 and into the chamber 137 located within the whistle cap 76, while also positioning free end 14 through a like channel and chamber on the opposite side of the cap 76. Next, the user slides the outer frame 74 over the whistle cap 76 and whistle body 72 until the outer frame 74 snap fits onto both, thereby securing the free ends 12, 14 of the cord 16 onto the zipper pull mechanism 70. According to one version of the invention, the snap fit arrangement is accomplished by wall 144 on cap 76 interacting with a lock wedge or similar projecting member (not shown) positioned on the inside surface of frame 74. According to another aspect of the present invention, the exemplary zipper pull mechanism 70 can be assembled in the following manner. The free ends 12, 14 of the cord 16 can be positioned between side walls 86 of whistle body 72 and the front end walls or wings 98. Thereafter, the outer frame 74 can be snap-fitted onto whistle body 72 in such a manner that the free ends 12, 14 of the cord 16 are securely captured therein. In any case, as with the other embodiments, it should be appreciated that to no special tools are required to assemble the zipper pull mechanism 70.

Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A zipper pull mechanism with an integrated whistle comprising:

a whistle body defining a front end, a back end, and an upper surface, the whistle body further including a first aperture and a second aperture; an outer frame positioned over the whistle body, the outer frame further including an opening such that when the outer frame is positioned over the whistle body, the opening in the outer frame is aligned with the second aperture of the whistle body so that when air is passed through the first aperture in the whistle body, the air is allowed to continue to pass through the second aperture of the whistle body and the opening in the outer frame to thereby create a loud, piercing noise, wherein the first aperture in the whistle body extends through the front end of the whistle body, and the second aperture in the whistle body extends through the upper surface of the whistle body; and an attachment device having a first free end and a second free end such that the free ends of the attachment device are captured between the whistle body and the outer frame in a manner that allows the attachment device to include a looped portion outside the whistle body and the outer frame that is adapted for attachment to a zipper member.

2. A zipper pull mechanism with an integrated whistle comprising:

a whistle body defining a front end, a back end, and an upper surface, the whistle body further including a first aperture and a second aperture; and an outer frame positioned over the whistle body in such a manner so as to allow a zipper ending to be secured to the zipper pull mechanism, the outer frame further including an opening such that when the outer frame is positioned over the whistle body, the opening in the outer frame is aligned with the second aperture of the whistle body so that when air is passed through the first aperture in the whistle body, the air is allowed to continue to pass through the second aperture of the whistle body and the opening in the outer frame to thereby create a loud, piercing noise, wherein the back end of the whistle body is open and a removable cap is further provided and adapted to be attached to the back end of the whistle body so as to close the back end of the whistle body.

3. A zipper pull mechanism with an integrated whistle comprising:

a whistle body defining a front end, a back end, and an upper surface, the whistle body further including a first aperture and a second aperture; and an outer frame positioned over the whistle body in such a manner so as to allow a zipper ending to be secured to the zipper pull mechanism, the outer frame further including an opening such that when the outer frame is positioned over the whistle body, the opening in the outer frame is aligned with the second aperture of the whistle body so that when air is passed through the first aperture in the whistle body, the air is allowed to continue to pass through the second aperture of the whistle body and the opening in the outer frame to thereby create a loud, piercing noise, wherein the outer frame defines a concave shaped top surface wall, the opening in the outer frame being positioned within the concave shaped top suite wall.

4. The zipper pull mechanism as set forth in claim 3, wherein the concave shaped surface wall further includes at least one gripping element.

5. A zipper pull mechanism with an integrated whistle comprising:

a whistle body defining a front end, a back end, and an upper surface, the whistle body further including a first aperture and a second aperture, and an outer frame positioned over the whistle body in such a manner so as to allow a zipper ending to be secured to the zipper pull mechanism, the outer frame farther including an opening such that when the outer frame is positioned over the whistle body, the opening in the outer frame is aligned with the second aperture of the whistle body so that when air is passed through the first aperture in the whistle body, the air is allowed to continue to pass through the second aperture of the whistle body and the opening in the outer frame to thereby create a loud, piercing noise, wherein the whistle body further defines a bottom surface, the bottom surface includes a hole for permitting the escape of fluid out through the bottom surface of the whistle body.

6. A zipper pull mechanism with an integrated whistle comprising:

a whistle body defining a from end, a back end, and an upper surface, the whistle body further including a first aperture and a second aperture;

an outer frame positioned over the whistle body in such a manner so as to allow a zipper ending to be secured to the zipper pull mechanism, the outer frame thither including an opening such that when the outer flame is positioned over the whistle body, the opening in the outer frame is aligned with the second aperture of the whistle body so that when air is passed through the first aperture in the whistle body, the air is allowed to continue to pass through the second aperture of the whistle body and the opening in the outer flame to thereby create a loud, piercing noise; wherein the zipper ending is at least one cord end of a zipper cord; and an attachment device having a first free end and a second free end such that the free ends of the attachment device are captured between the whistle body and the outer frame in a manner that allows the attachment device to include a looped portion outside the whistle body and the outer frame that is adapted for attachment to the zipper ending.

7. A zipper pull assembly with an integrated whistle comprising:

a whistle body defining a front end, an open back end, and an upper surface, the whistle body further defining an aperture extending through the front end and out the upper surface;

a cap connected to the back end of the whistle body so as to close the back end, the cap being adapted for removal from the whistle body; and an outer frame positioned over the whistle body, the outer frame defining an upper surface and an air exhaust hole aligned with the aperture extending out of the upper surface.

8. The zipper pull assembly as set forth in claim 7, wherein the whistle body is adapted to be snap-fitted to the outer frame.

9. The zipper pull assembly as set forth in claim 7, wherein the upper suffice of the outer frame defines a recess, the exhaust hole positioned within the recess of the upper surface.

10. The zipper pull assembly as set forth in claim 7, wherein the outer frame includes at least one gripping element.

11. The zipper pull assembly as set forth in claim 7, wherein the outer frame includes at least one guidance lug to align the whistle body within the outer frame.

12. A zipper pull assembly comprising:

a whistle body defining a from end, an open back end, an outer surface, and a whistle-forming passage extending therethough, the whistle-forming passage having an inlet and an outlet;

a cap attached to the back end of the whistle body to close the back end;

an outer frame positioned over the whistle body and defining an outer surface, the outer surface including an exhaust hole aligned with the outlet of the whistle-forming passage of the whistle body; and a cord having a first free end and a second free end such that the free ends of the cord are captured between the whistle body and the outer frame in a manner that allows the cord to include a looped portion outside the whistle body and the outer frame that is adapted for attachment to a zipper member.

13. The assembly as set forth in claim 12, wherein the whistle body and the outer frame are adapted to snap fit together.

14. The assembly as set forth in claim 12, wherein the cap and the whistle body are adapted to snap fit together.

15. The assembly as set forth in claim 12, wherein the outer surface of the whistle body and the outer surface of the outer frame each include an additional hole for permitting the escape of fluid out of the assembly.

16. The assembly as set forth in claim 12, wherein the cap includes a top surface having a chamber with a channel leading into and out of the chamber, and a bottom surface having a chamber with a channel leading into and out of the chamber, such that one free end of the cord passes through the channel in the top surface of the cap and into the associated chamber, and the other free end of the cord passes through the channel in the bottom surface of the cap and into the associated chamber, the channels in the top surface and the bottom surface being located on opposite sides of the cap.

17. The assembly as set forth in claim 12, wherein the front end of the whistle body is contoured and terminates in first wing member located adjacent one side of the whistle body and a second wing member located adjacent an opposite side of the whistle body so as to define a space between each wing member and the associated side of the whistle body, such that the first free end of the cord is positioned in one of the spaces and the second free end of the cord is positioned in the other of the spaces.

* * * * *